US009519262B1

(12) United States Patent
Tonges et al.

(10) Patent No.: US 9,519,262 B1
(45) Date of Patent: Dec. 13, 2016

(54) POSITIONING FEATURES AND ELECTRICAL CONTACTS FOR A REPLACEABLE UNIT OF AN ELECTROPHOTOGRAPHIC IMAGE FORMING DEVICE

(71) Applicant: LEXMARK INTERNATIONAL, INC., Lexington, KY (US)

(72) Inventors: Jeffrey Lawrence Tonges, Versailles, KY (US); Benjamin Erich Kant, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/941,809

(22) Filed: Nov. 16, 2015

Related U.S. Application Data

(60) Provisional application No. 62/240,791, filed on Oct. 13, 2015.

(51) Int. Cl.
*G03G 21/18* (2006.01)
*G03G 21/16* (2006.01)
*G03G 15/00* (2006.01)

(52) U.S. Cl.
CPC ..... *G03G 21/1671* (2013.01); *G03G 15/751* (2013.01)

(58) Field of Classification Search
None
See application file for complete search history.

(56) References Cited

U.S. PATENT DOCUMENTS

| | | | | |
|---|---|---|---|---|
| 7,082,275 | B2 | 7/2006 | Portig et al. | |
| 7,831,168 | B2 | 11/2010 | Allen et al. | |
| 2008/0159772 | A1 | 7/2008 | Koishi et al. | |
| 2008/0292356 | A1* | 11/2008 | Furuichi | G03G 21/1853 399/112 |
| 2011/0013925 | A1* | 1/2011 | Kim | G03G 21/1867 399/90 |
| 2014/0169824 | A1 | 6/2014 | Seto et al. | |

* cited by examiner

*Primary Examiner* — David Gray
*Assistant Examiner* — Thomas Giampaolo, II
(74) *Attorney, Agent, or Firm* — Justin M. Tromp

(57) ABSTRACT

A photoconductor unit for an electrophotographic image forming device according to one example embodiment includes a housing having a first end wall positioned at a first end of the housing. A photoconductive drum is mounted on the housing and has a rotational axis that runs from the first end to a second end of the housing. An electrically conductive first biasing member extends axially inward with respect to the photoconductive drum from an inner axial side of the first end wall. The first biasing member is exposed on the inner axial side of the first end wall to contact and force a developer unit toward the second end of the housing when the developer unit is operably mated with the photoconductor unit and to contact and form an electrical path with a corresponding electrical contact on the developer unit when the developer unit is operably mated with the photoconductor unit.

12 Claims, 10 Drawing Sheets

POSITIONING FEATURES AND ELECTRICAL CONTACTS FOR A REPLACEABLE UNIT OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/240,791, filed Oct. 13, 2015, entitled "Positioning Features and Electrical Contacts for a Replaceable Unit of an Electrophotographic Image Forming Device," the content of which is hereby incorporated by reference in its entirety.

BACKGROUND

1. Field of the Disclosure

The present invention relates generally to electrophotographic printers and more particularly to positioning features and electrical contacts for a replaceable unit of an electrophotographic image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. The image forming device's main toner supply, which is consumed relatively quickly, is provided in a large reservoir in a first replaceable unit, which may be referred to as a toner cartridge. Relatively longer life components are provided in one or more additional replaceable units. For example, the developer roll, toner adder roll, doctor blade and a relatively small reservoir of toner (in the case of a single component development image forming device) or the magnetic roll and a relatively small reservoir containing a mix of toner and magnetic carrier beads (in the case of a dual component development image forming device) may be provided in a second replaceable unit, which may be referred to as a developer unit. The photoconductive drum, charge roll and cleaner blade/roll may be provided in a third replaceable unit, which may be referred to as a photoconductor unit. Alternatively, the developer unit and photoconductor unit may be joined in a single replaceable unit. This configuration allows replenishment of the image forming device's toner supply without replacing the developer unit or photoconductor unit. This configuration also allows the developer unit and the photoconductor unit to be repaired or replaced independent of the image forming device's main toner supply.

It is important that the replaceable units are precisely aligned within the image forming device for proper operation. The requirement for precise alignment must be balanced with the need to permit a user to easily load and unload the replaceable units into and out of the image forming device.

SUMMARY

A photoconductor unit for an electrophotographic image forming device according to one example embodiment includes a housing having a top, a bottom, a first side and a second side formed between a first end and a second end of the housing. A first end wall is positioned at a first end of the housing. A photoconductive drum is mounted on the housing and has a rotational axis that runs from the first end to the second end. An electrically conductive first biasing member extends axially inward with respect to the photoconductive drum from an inner axial side of the first end wall. The inner axial side of the first end wall faces toward the second end of the housing. The first biasing member is exposed on the inner axial side of the first end wall to contact and force a developer unit toward the second end of the housing when the developer unit is operably mated with the photoconductor unit and to contact and form an electrical path with a corresponding electrical contact on the developer unit when the developer unit is operably mated with the photoconductor unit.

A photoconductor unit for an electrophotographic image forming device according to another example embodiment includes a housing having a top, a bottom, a first side and a second side formed between a first end and a second end of the housing. A first end wall is positioned at a first end of the housing. A photoconductive drum is mounted on the housing and has a rotational axis that runs from the first end to the second end. A first flexible metal tab extends axially inward with respect to the photoconductive drum from an inner axial side of the first end wall. The inner axial side of the first end wall faces toward the second end of the housing. The first flexible metal tab is exposed on the inner axial side of the first end wall to contact and force a developer unit toward the second end of the housing when the developer unit is operably mated with the photoconductor unit and to contact and form an electrical path with a corresponding electrical contact on the developer unit when the developer unit is operably mated with the photoconductor unit.

A replaceable unit for an electrophotographic image forming device according to one example embodiment includes a photoconductor unit portion that includes a photoconductive drum having a first rotational axis that extends from a first end of the replaceable unit to a second end of the replaceable unit. A developer unit portion includes a reservoir for storing toner and a developer roll having a second rotational axis that extends from the first end of the replaceable unit to the second end of the replaceable unit. An outer surface of the developer roll is positioned along an outer surface of the photoconductive drum to deliver toner from the reservoir to the photoconductive drum. An electrically conductive first biasing member is positioned between the photoconductor unit portion and the developer unit portion forcing the developer unit portion axially with respect to the photoconductive drum toward the second end of the replaceable unit and forming an electrical path between a first electrical contact on the developer unit portion and a second electrical contact on the photoconductor unit portion.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
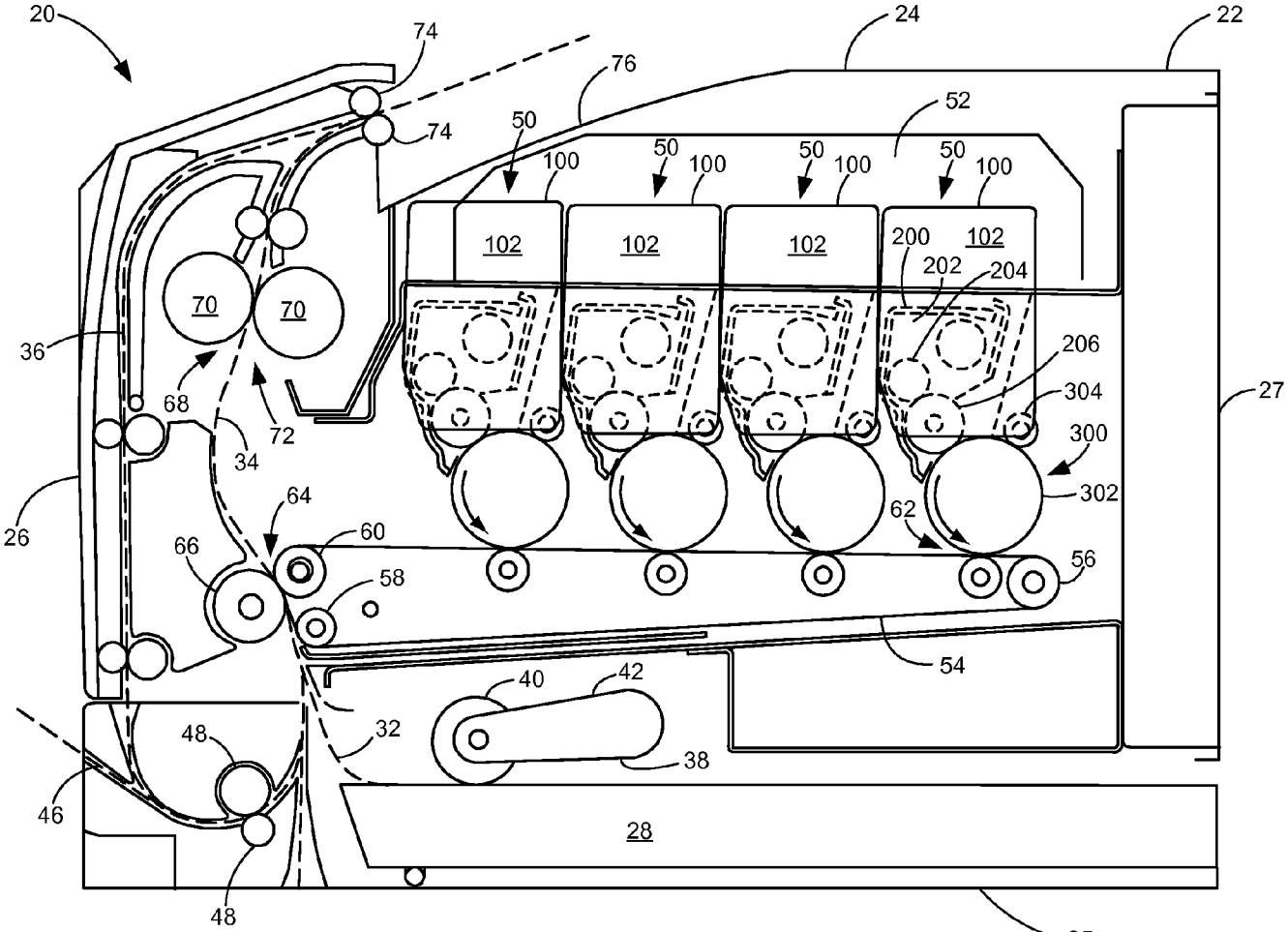
FIG. 1 is a schematic side view of the interior of an image forming device according to one example embodiment.

FIG. 1 illustrates a schematic view of the interior of an example image forming device 20. Image forming device 20 includes a housing 22 having a top 24, bottom 25, front 26 and rear 27. Housing 22 includes one or more input trays 28 positioned therein.

Trays 28 are sized to contain a stack of media sheets. As used herein, the term media is meant to encompass not only paper but also labels, envelopes, fabrics, photographic paper or any other desired substrate. Trays 28 are preferably removable for refilling. A control panel (not shown) may be located on housing 22. Using the control panel, a user is able to enter commands and generally control the operation of the image forming device 20. For example, the user may enter commands to switch modes (e.g., color mode, monochrome mode), view the number of pages printed, etc. A media path 32 extends through image forming device 20 for moving the media sheets through the image transfer process. Media path 32 includes a simplex path 34 and may include a duplex path 36. A media sheet is introduced into simplex path 34 from tray 28 by a pick mechanism 38. In the example embodiment shown, pick mechanism 38 includes a roll 40 positioned at the end of a pivotable arm 42. Roll 40 rotates to move the media sheet from tray 28 and into media path 32. The media sheet is then moved along media path 32 by various transport rolls. Media sheets may also be introduced into media path 32 by a manual feed 46 having one or more rolls 48.

Image forming device 20 includes an image transfer section that includes one or more imaging stations 50. In the example embodiment illustrated, each imaging station 50 includes a toner cartridge 100, a developer unit 200 and a photoconductor unit 300. Each toner cartridge 100 includes a reservoir 102 for holding toner and an outlet port in communication with an inlet port of a corresponding developer unit 200 for periodically transferring toner from reservoir 102 to developer unit 200 in order to replenish the developer unit 200. One or more agitating members may be positioned within reservoir 102 to aid in moving the toner. In the example embodiment illustrated, image forming device 20 utilizes what is commonly referred to as a single component development system. In this embodiment, each developer unit 200 includes a toner reservoir 202 and a toner adder roll 204 that moves toner from reservoir 202 to a developer roll 206. Each photoconductor unit 300 includes a charge roll 304, a photoconductive (PC) drum 302 and a cleaner blade or roll (not shown). PC drums 302 are mounted substantially parallel to each other. For purposes of clarity, developer unit 200 and photoconductor unit 300 are labeled on only one of the imaging stations 50. Each imaging station 50 may be substantially the same except for the color of toner used.

Each charge roll 304 forms a nip with the corresponding PC drum 302. During a print operation, charge roll 304 charges the surface of PC drum 302 to a specified voltage such as, for example, −1000 volts. A laser beam from a printhead 52 associated with each imaging station 50 is then directed to the surface of PC drum 302 and selectively discharges those areas it contacts to form a latent image on the surface of PC drum 302. In one embodiment, areas on PC drum 302 illuminated by the laser beam are discharged to approximately −300 volts. Developer roll 206, which forms a nip with the corresponding PC drum 302, then transfers toner to the latent image on the surface of PC drum 302 to form a toner image. The toner is attracted to the areas of PC drum 302 surface discharged by the laser beam from the printhead 52. A metering device, such as a doctor blade, can be used to meter toner onto developer roll 206 and apply a desired charge on the toner prior to its transfer to PC drum 302.

An intermediate transfer mechanism (ITM) 54 is disposed adjacent to the imaging stations 50. In this embodiment, ITM 54 is formed as an endless belt trained about a drive roll 56, a tension roll 58 and a back-up roll 60. During image forming operations, ITM 54 moves past imaging stations 50 in a clockwise direction as viewed in FIG. 1. One or more of PC drums 302 apply toner images in their respective colors to ITM 54 at a first transfer nip 62. In one embodiment, a positive voltage field attracts the toner image from PC drums 302 to the surface of the moving ITM 54. ITM 54 rotates and collects the one or more toner images from imaging stations 50 and then conveys the toner images to a media sheet at a second transfer nip 64 formed between a transfer roll 66 and ITM 54, which is supported by back-up roll 60. The cleaner blade/roll of each photoconductor unit 300 removes any toner remnants on PC drum 302 so that the surface of PC drum 302 may be charged and developed with toner again.

A media sheet advancing through simplex path 34 receives the toner image from ITM 54 as it moves through the second transfer nip 64. The media sheet with the toner image is then moved along the media path 32 and into a fuser area 68. Fuser area 68 includes fusing rolls or belts 70 that form a nip 72 to adhere the toner image to the media sheet. The fused media sheet then passes through exit rolls 74 that are located downstream from the fuser area 68. Exit rolls 74 may be rotated in either forward or reverse directions. In a forward direction, exit rolls 74 move the media sheet from simplex path 34 to an output area 76 on top 24 of image forming device 20. In a reverse direction, exit rolls 74 move the media sheet into duplex path 36 for image formation on a second side of the media sheet.

While the example image forming device 20 shown in FIG. 1 illustrates four toner cartridges 100 and four corresponding developer units 200 and photoconductor units 300, it will be appreciated that a monocolor image forming device 20 may include a single toner cartridge 100 and corresponding developer unit 200 and photoconductor unit 300 as compared to a multicolor image forming device 20 that may include multiple toner cartridges 100, developer units 200 and photoconductor units 300. Further, although image forming device 20 utilizes ITM 54 to transfer toner to the media, toner may be applied directly to the media by the one or more PC drums 302 as is known in the art.

While the example image forming device 20 shown in FIG. 1 utilizes a single component development system, in another embodiment, image forming device 20 utilizes what is commonly referred to as a dual component development system. In this embodiment, reservoir 202 of developer unit 200 stores a mixture of toner and magnetic carrier beads. The carrier beads may be coated with a polymeric film to provide triboelectric properties to attract toner to the carrier beads as the toner and the carrier beads are mixed in reservoir 202. Each developer unit 200 also includes a magnetic roll that attracts the carrier beads in reservoir 202 having toner thereon to the magnetic roll through the use of magnetic fields and transports the toner to the corresponding PC drum 302. Electrostatic forces from the latent image on PC drum 302 strip the toner from the carrier beads to form a toner image on the surface of PC drum 302. PC drum 302 is charged by charge roll 304 and cleaned by a cleaner blade/roll as discussed above.

Figure 2:
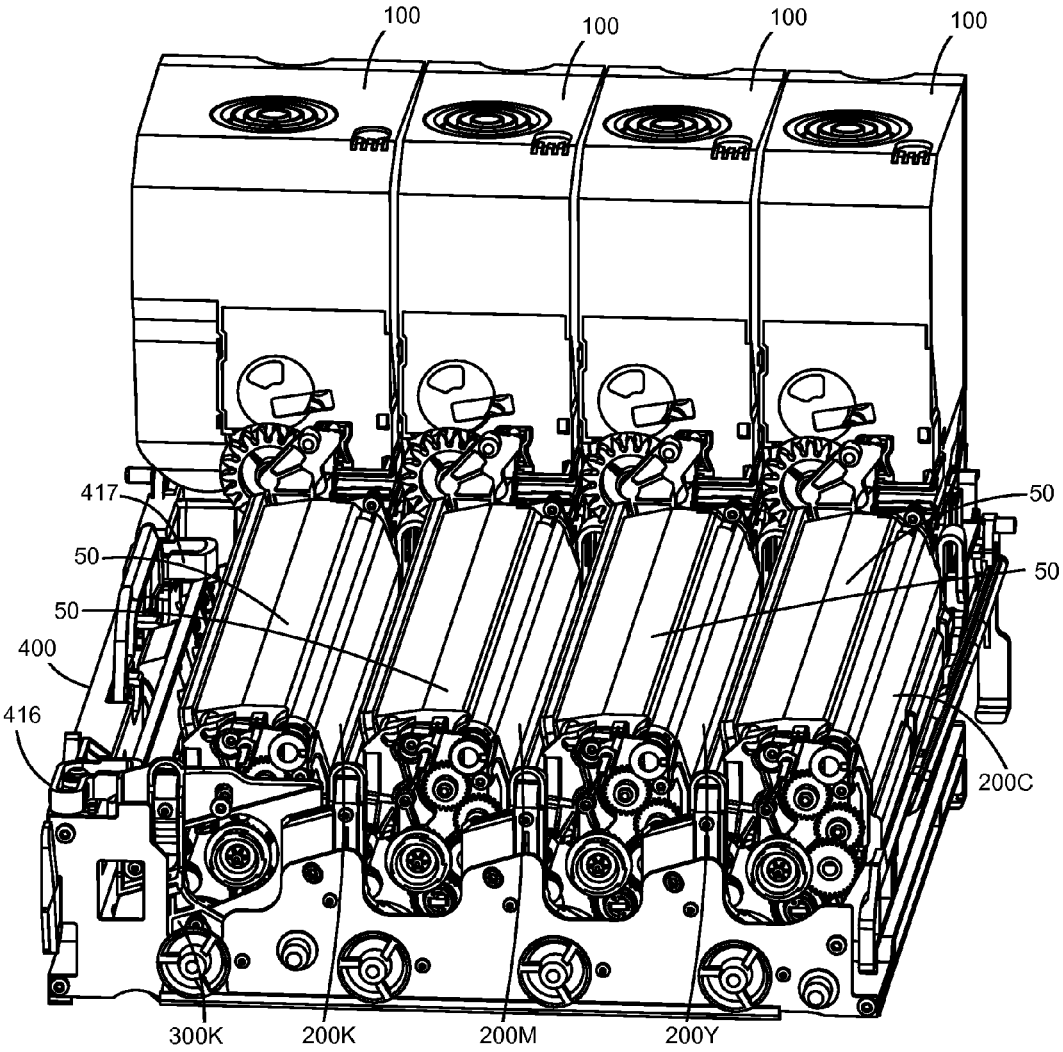
FIG. 2 is a perspective view of an imaging basket loaded with four toner cartridges, developer units and photoconductor units according to one example embodiment.
Figure 3:
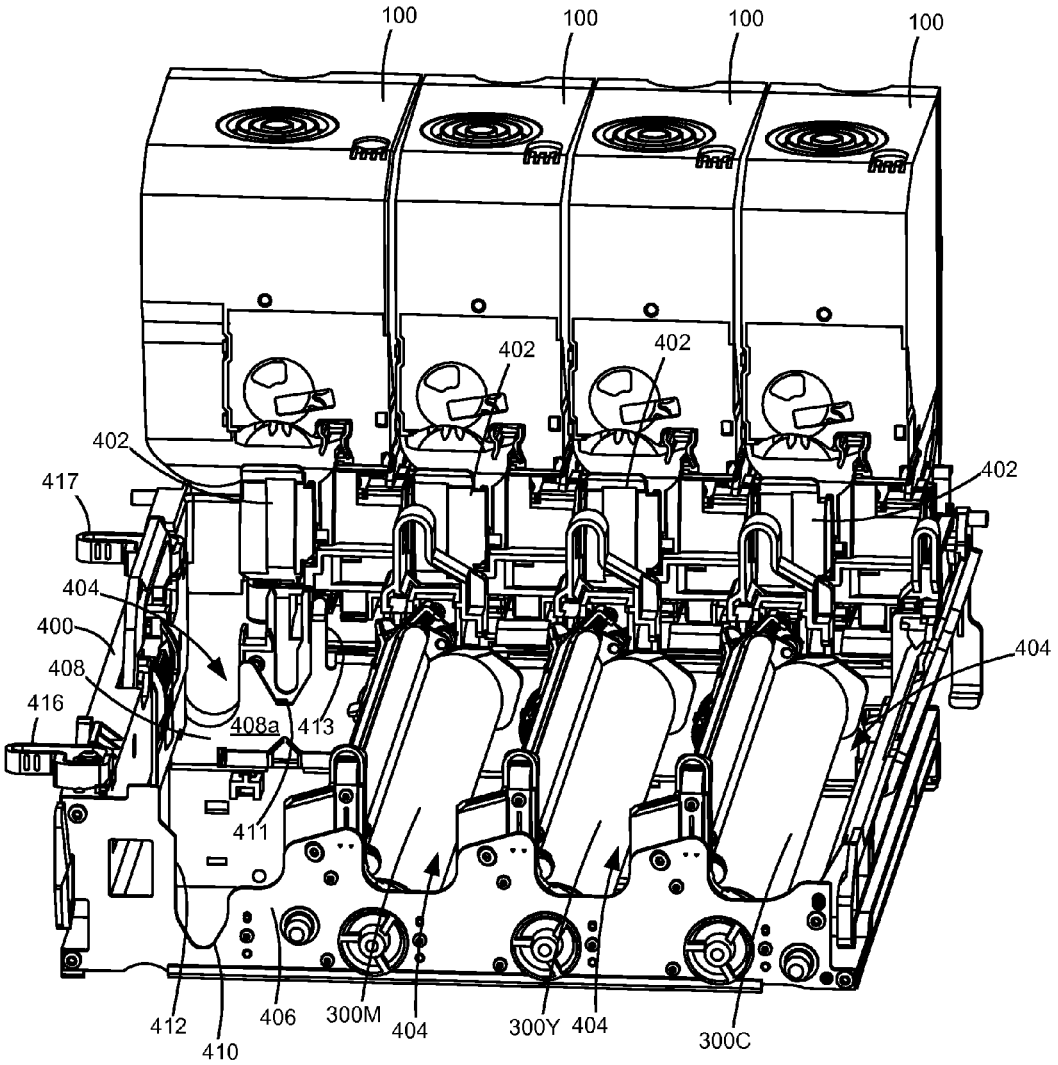
FIG. 3 is a perspective view of the imaging basket shown in FIG. 2 with the developer units and a black photoconductor unit removed according to one example embodiment.

With reference to FIGS. 2 and 3, image forming device 20 includes an imaging basket 400 that holds imaging stations 50. In some embodiments, imaging basket 400 is removably installable in image forming device 20. Imaging basket 400 includes four cradles 402 that each hold a respective toner cartridge 100 and four positioning slots 404 that each hold a respective developer unit 200. Toner cartridges 100 and developer units 200 are separately removable from imaging basket 400 in order to permit replacement of each toner cartridge 100 and developer unit 200 individually. Photoconductor units 300 may be removable from imaging basket 400 or fixed thereto. In the example embodiment illustrated, the photoconductor unit 300K on the far left as viewed in FIG. 2, which forms part of the black toner imaging station 50, is removable from imaging basket 400 while the remaining three photoconductor units 300M, 300Y, 300C, which form parts of the colored toner (e.g., magenta, yellow and cyan) imaging stations 50, are fixed to imaging basket 400. This configuration permits replacement of the black photoconductor unit 300K separate from the colored photoconductor units 300M, 300Y, 300C in the event that the black photoconductor unit 300K requires replacement more frequently than the colored photoconductor units 300M, 300Y, 300C due to higher consumption of black toner than colored toner. In other embodiments, all or a subset of colored photoconductor units 300M, 300Y, 300C may be individually removable from imaging basket 400 as desired. FIG. 2 illustrates imaging basket 400 with all four toner cartridges 100, developer units 200 and photoconductor units 300 installed therein. FIG. 3 illustrates imaging basket 400 with developer units 200 and black photoconductor unit 300K removed.

Figure 4:
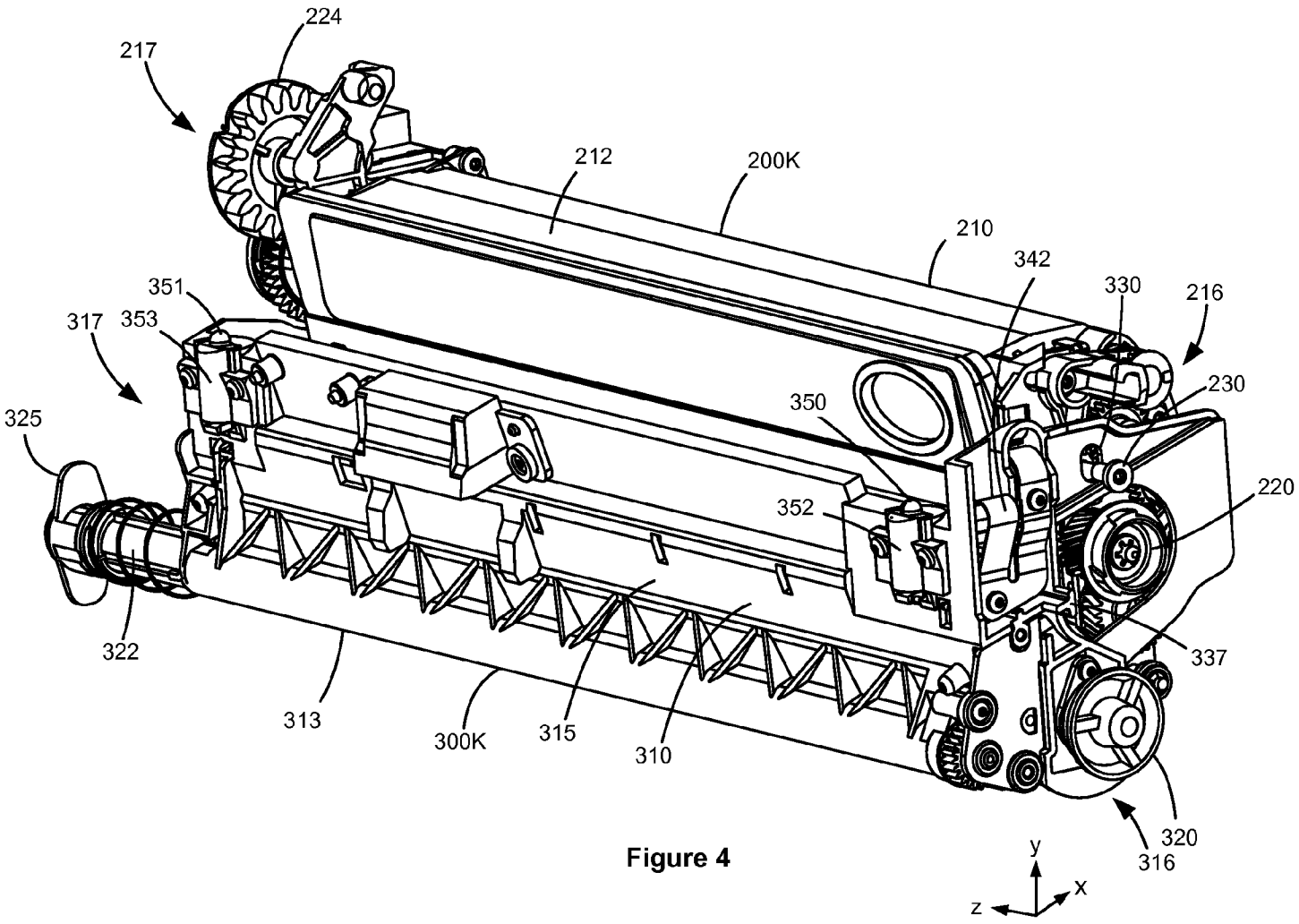
FIG. 4 is a first perspective view of a developer unit and photoconductor unit operably mated together according to one example embodiment.
Figure 5:
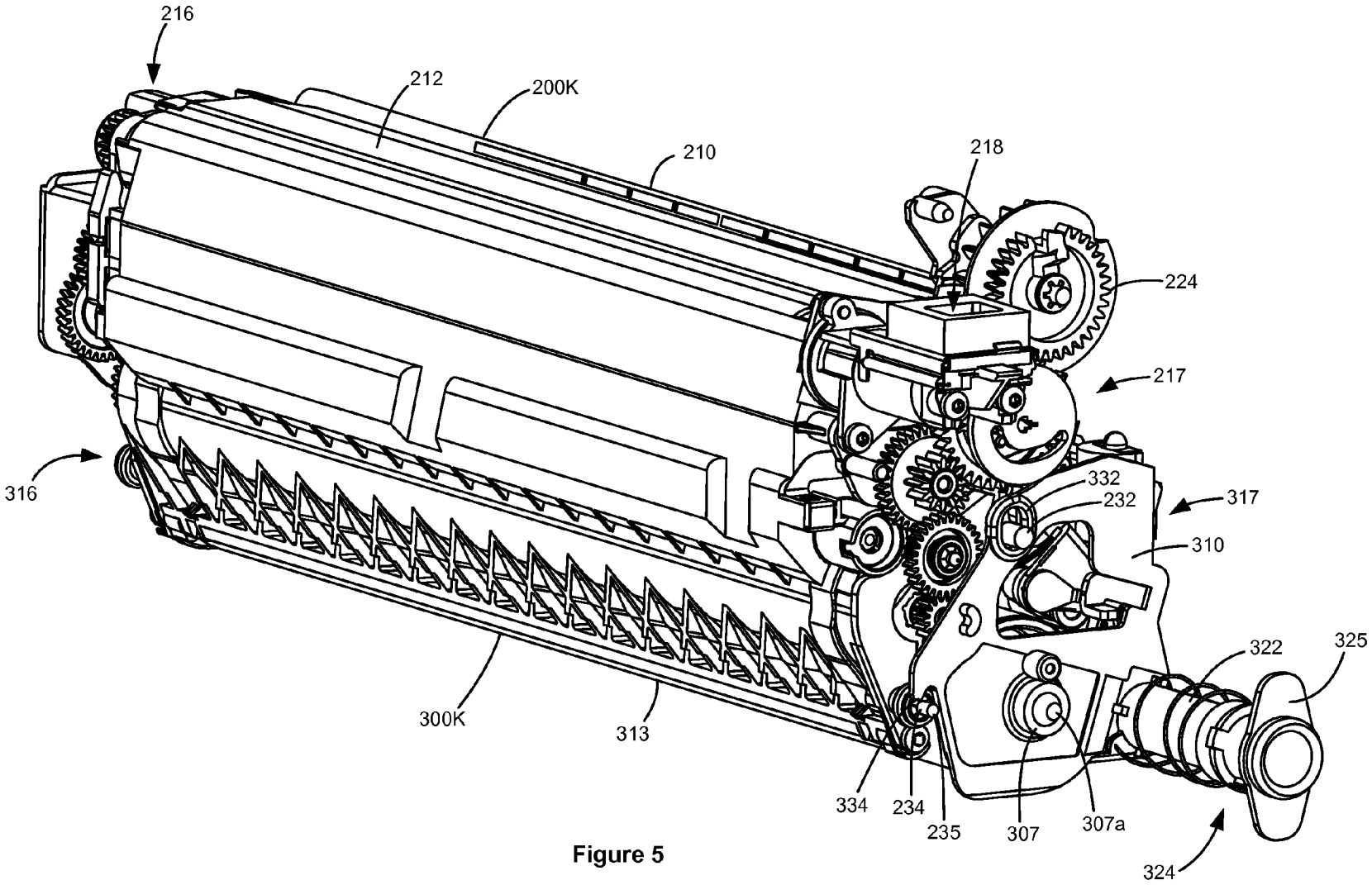
FIG. 5 is a second perspective view of the developer unit and photoconductor unit shown in FIG. 4 operably mated together.
Figure 6:
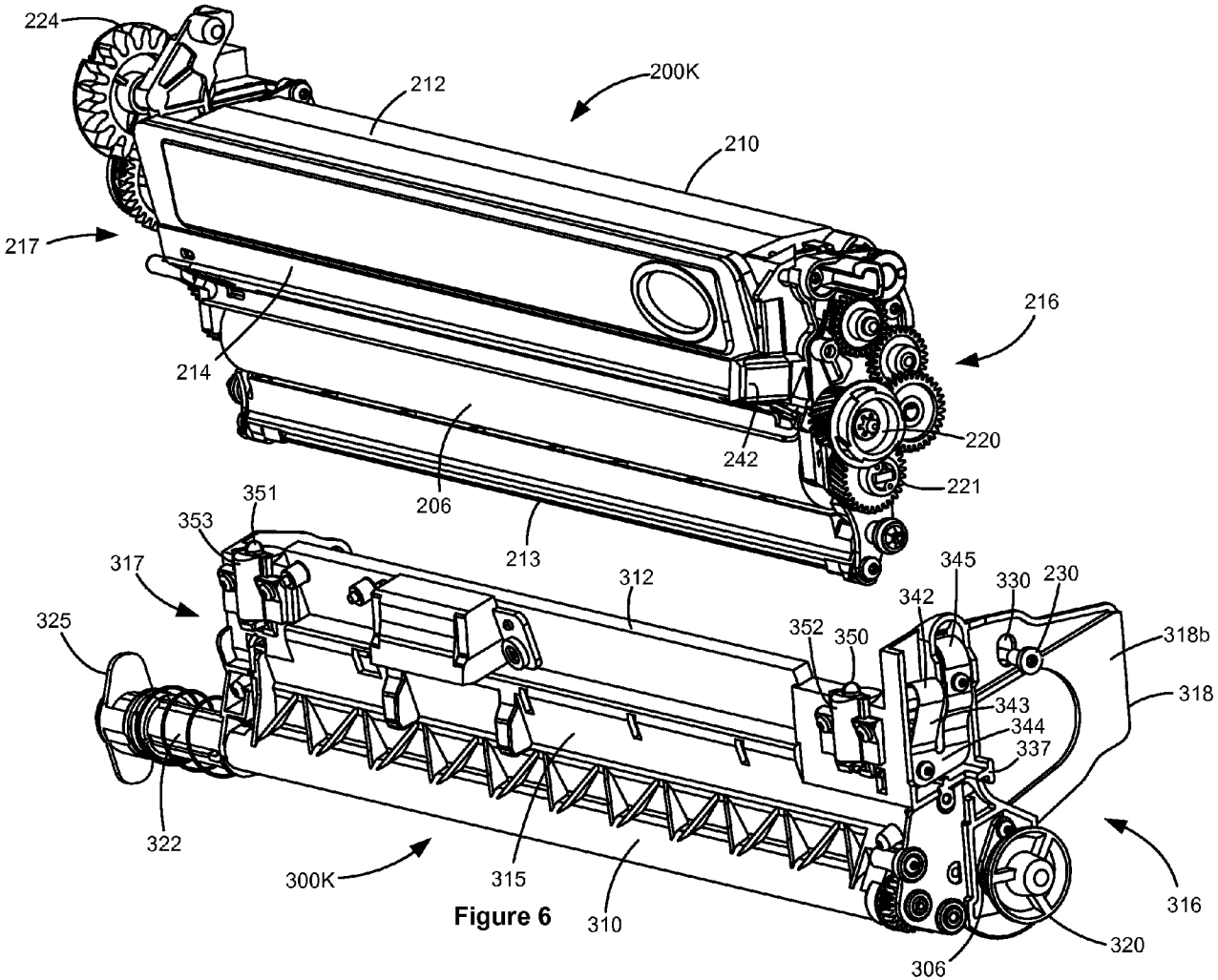
FIG. 6 is a first perspective view of the developer unit and photoconductor unit shown in FIGS. 4 and 5 separated from each other according to one example embodiment.
Figure 7:
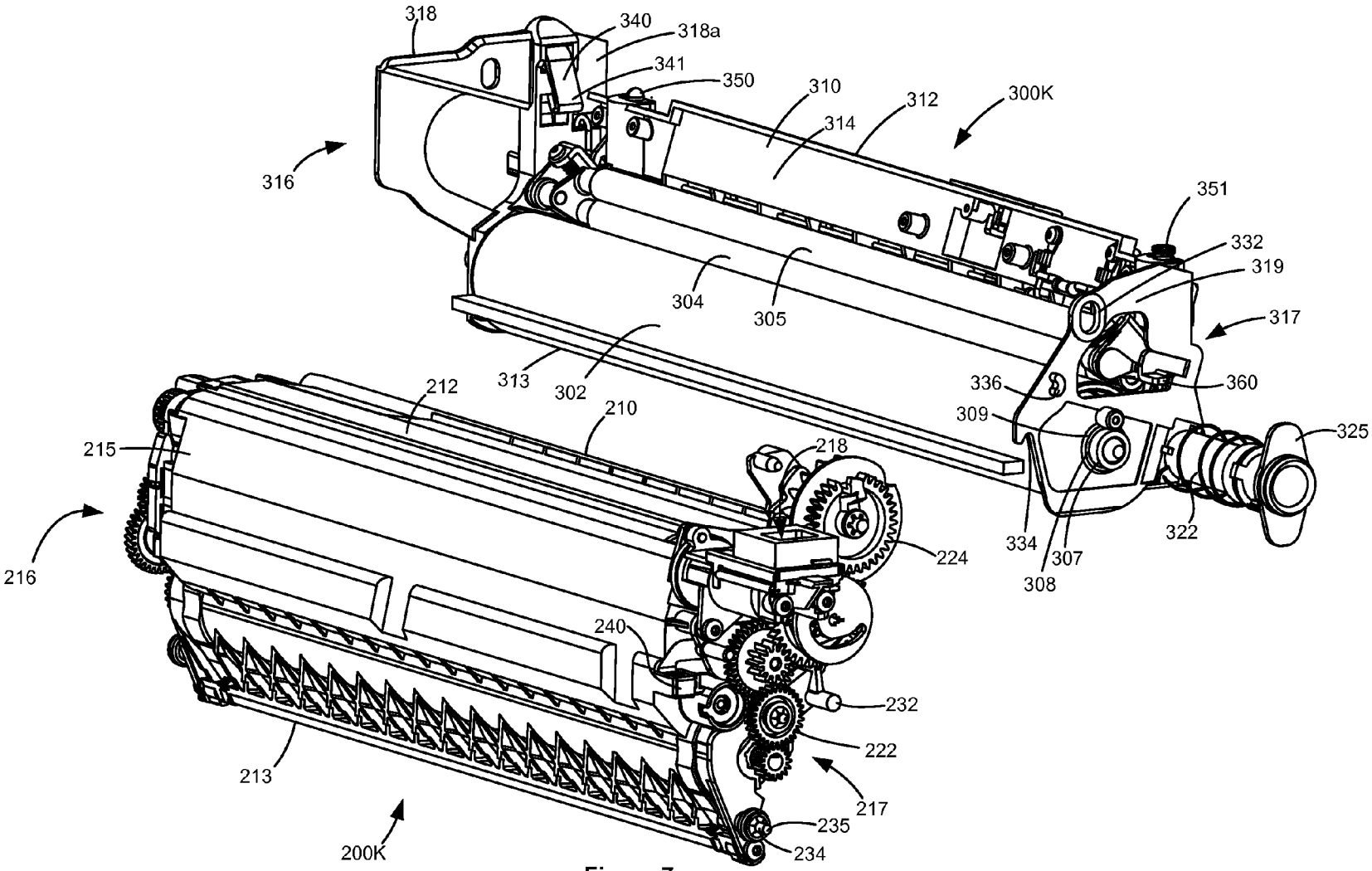
FIG. 7 is a second perspective view of the developer unit and photoconductor unit shown in FIGS. 4-6 separated from each other.

FIGS. 4-7 show removable photoconductor unit 300K and its corresponding developer unit 200K according to one example embodiment. FIGS. 4 and 5 show developer unit 200K operably mated with photoconductor unit 300K. FIGS. 6 and 7 show developer unit 200K separated from photoconductor unit 300K to more clearly illustrate the components of each unit.

Developer unit 200K includes a housing 210 having a top 212, a bottom 213, an inner side 214 that faces photoconductor unit 300K and an outer side 215 that faces away from photoconductor unit 300K. Top 212, bottom 213, inner side 214 and outer side 215 are positioned between a first end 216 and a second end 217 of housing 210. Reservoir 202 is enclosed within housing 210. A toner inlet port 218 is positioned at the top 212 of housing 210 on end 217 for receiving toner from toner cartridge 100 to replenish reservoir 202. Developer roll 206 runs axially from end 216 to end 217 and is exposed on inner side 214. Developer unit 200K includes an input drive coupler 220 exposed on end 216 of housing 210 to mate with and receive rotational motion from a drive system in image forming device 20 when developer unit 200K is installed in image forming device 20. Drive coupler 220 is operatively coupled to developer roll 206 through a drive train 221 on end 216 in order to rotate developer roll 206 when drive coupler 220 rotates. Drive train 221 also transfers rotational motion received by drive coupler 220, via developer roll 206, to toner adder roll 204 and to agitating members positioned within reservoir 202 that aid in moving toner therein. In the example embodiment illustrated, a drive train 222 is operatively connected to drive coupler 220 and positioned on end 217 of housing 210. Drive train 222 includes an output gear 224 positioned to mate with a corresponding input gear on toner cartridge 100 in order to transfer rotational motion to the components of toner cartridge 100.

Photoconductor unit 300K includes a housing 310 having a top 312, a bottom 313, an inner side 314 that faces developer unit 200K and an outer side 315 that faces away from developer unit 200K. Top 312, bottom 313, inner side 314 and outer side 315 are positioned between a first end 316 and a second end 317 of housing 310. Housing 310 includes a vertical end wall 318 positioned at end 316 and a vertical end wall 319 positioned at end 317. PC drum 302 runs axially from end 316 to end 317 and is exposed on inner side 314. PC drum 302 includes an input drive coupler 320 on one axial end of PC drum 302. Drive coupler 320 is exposed on end 316 of housing 310 to mate with and receive rotational motion from a drive system in image forming device 20 when photoconductor unit 300K is installed in image forming device 20 in order to rotate PC drum 302. Charge roll 304 is biased against the outer surface of PC drum 302 and may be driven by friction between the surfaces of charge roll 304 and PC drum 302 or by a gear train connected to drive coupler 320. In the embodiment illustrated, a charge roll cleaner roll 305 is in contact with the outer surface of charge roll 304 and removes toner remnants from the outer surface of charge roll 304. Charge roll cleaner roll 305 may be driven by friction between the surfaces of charge roll cleaner roll 305 and charge roll 304 or by a gear train connected to drive coupler 320.

Photoconductor unit 300K may also include a waste toner path that includes a toner conveying member, such as an auger, therein that moves toner cleaned from PC drum by the cleaner blade/roll to a waste toner compartment in image forming device 20. In the example embodiment illustrated, the waste toner path includes a tube 322 that extends outward in a cantilevered manner from end 317 of housing 310. Tube 322 includes a waste toner outlet port 324 positioned to exit waste toner from the waste toner path into a corresponding waste toner inlet in image forming device 20 when photoconductor unit 300K is installed in image forming device 20. Waste toner outlet port 324 may include a shutter 325 that is movable between a closed position blocking waste toner outlet port 324 to prevent toner from leaking from waste toner outlet port when photoconductor unit 300K is removed from image forming device 20 and an open position unblocking waste toner outlet port 324 to permit toner to pass from the waste toner path in photoconductor unit 300K to the waste toner compartment in image forming device 20 when photoconductor unit 300K is installed in image forming device 20.

In the example embodiment illustrated, developer unit 200K and photoconductor unit 300K are fixed to one another such that developer unit 200K and photoconductor unit 300K are replaceable as a single unit. FIGS. 4 and 5 show developer unit 200K and photoconductor unit 300K fixed together according to one example embodiment. With reference to FIG. 4, in the example embodiment illustrated, a shoulder screw 230 is attached to end 216 of housing 210 and retained within an elongated slot 330 on end 316 of housing 310. With reference to FIG. 5, in this embodiment, a post 232 extends outward from end 217 of housing 210 and is retained within an elongated slot 332 on end 317 of housing 310. Elongated slots 330, 332 provide screw 230 and post 232 with limited freedom of movement in order to allow developer unit 200K to move to a limited degree relative to photoconductor unit 300K in order to maintain engagement between developer roll 206 and PC drum 302 during operation. Further, in the embodiment illustrated, a post 234 that extends outward from end 217 of housing 210 is retained within a hook 334 on end 317 of housing 310 in order to limit the extent to which developer unit 200K is able to rotate relative to photoconductor unit 300K. The manner of attachment of developer unit 200K to photoconductor unit 300K illustrated is not intended to be limiting. Developer unit 200K and photoconductor unit 300K may be attached to each other by any suitable method. Further, in other embodiments, developer unit 200K and photoconductor unit 300K are not fixed to each other and are separately replaceable.

With reference to FIG. 3, in one embodiment, imaging basket 400 includes a plate 406, 408 at each end 316, 317 of photoconductor unit 300K that is manufactured out of stamped metal in order to permit precise control of the location of PC drum 302 of photoconductor unit 300K relative to the PC drums 302 of photoconductor units 300M, 300Y, 300C as well as ITM belt 54 and printhead 52. Each plate 406, 408 includes a v-shaped notch 410, 411 therein that is open at its top. With reference back to FIGS. 6 and 7, photoconductor unit 300K includes a bushing 306, 307 at each axial end of PC drum 302. When photoconductor unit 300K is installed in imaging basket 400, the bottom surfaces of bushings 306, 307 rest in the v-shaped notches 410, 411 in plates 406, 408. The contact between bushings 306, 307 and v-shaped notches 410, 411 defines the position of PC drum 302 in the vertical dimension (y-dimension in FIG. 4) and the side-to-side dimension (x-dimension in FIG. 4) of photoconductor unit 300K. Photoconductor unit 300K also includes a rotational stop 336, 337 on each end 316, 317 of housing 310, respectively. Each rotational stop 336, 337 contacts a corresponding stop 412, 413 on plate 406, 408, respectively, in order to prevent rotation of photoconductor unit 300K when photoconductor unit 300K is installed in imaging basket 400.

Figure 8:
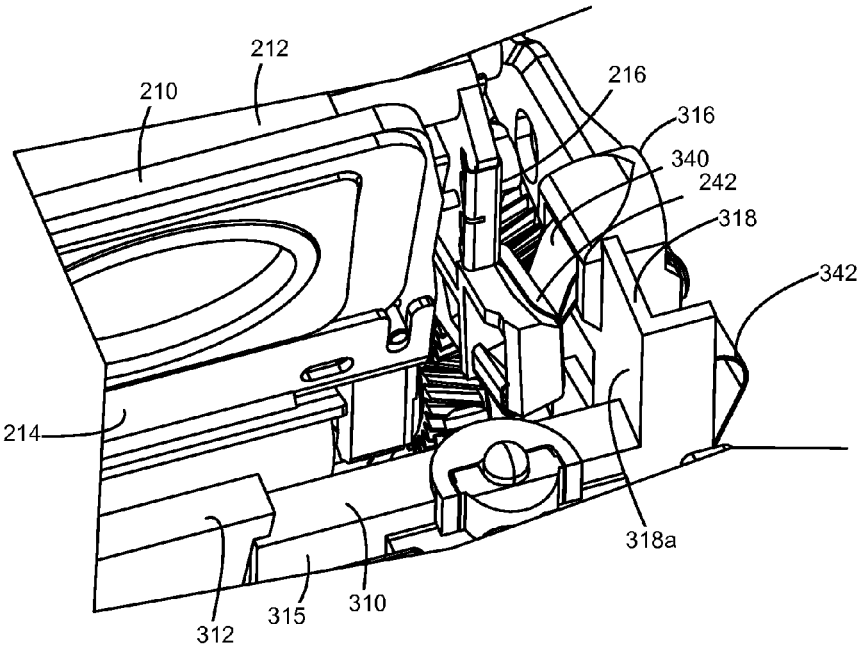
FIG. 8 is a perspective view showing a first biasing member of the photoconductor unit in contact with the developer unit biasing the developer unit along an axial dimension of the developer unit according to one example embodiment.

With reference to FIGS. 7 and 8, photoconductor unit 300K includes a biasing member 340 on an inner side 318*a* of end wall 318. In the embodiment illustrated, biasing member 340 is positioned above (closer to top 312) PC drum 302 and charge roll 304. Biasing member 340 extends inward axially with respect to PC drum 302 from inner side 318*a* of end wall 318 and is exposed on inner side 318*a* of end wall 318 in position to contact end 216 of housing 210 of developer unit 200K when developer unit 200K is operably mated with photoconductor unit 300K. As shown in FIG. 8, when developer unit 200K is operably mated with photoconductor unit 300K, biasing member 340 flexes between end 216 of housing 210 and inner side 318*a* of end wall 318 of housing 310 thereby imparting an axial force on developer unit 200K along the axial dimension of developer roll 206 toward end 217 of housing 210 and end 317 of housing 310. The force from biasing member 340 on developer unit 200K pushes housing 210 against an axial stop on photoconductor unit 300K or imaging basket 400 and, in this manner, defines the axial position of developer unit 200K. For example, in the embodiment illustrated, the force from biasing member 340 on developer unit 200K pushes a distal end 235 of post 234 against an inner surface 408*a* (FIG. 3) of plate 408 in order to ensure that developer roll 206 is aligned axially with PC drum 302. In the example embodiment illustrated, biasing member 340 is a leaf spring; however, any suitable biasing member may be used, such as, for example, a compression spring or a material having resilient properties. In the example embodiment illustrated, biasing member 340 includes a tab 341 that extends inward axially with respect to PC drum 302 and downward toward bottom 313 at an angle to inner side 318*a* of end wall 318 when tab 341 is in its home position, i.e., when tab 341 is not deflected due to contact with developer unit 200K. In other embodiments, tab 341 extends upward toward top 312 or sideways toward side 314 or 315 in order to form an angle to inner side 318*a* of end wall 318 when tab 341 is in its home position. In other embodiments, biasing member 340 is positioned on an outer side of first end 216 of housing 210 of developer unit 200 and contacts inner side 318*a* of end wall 318 of housing 310 thereby imparting the axial force on developer unit 200K.

Figure 9:
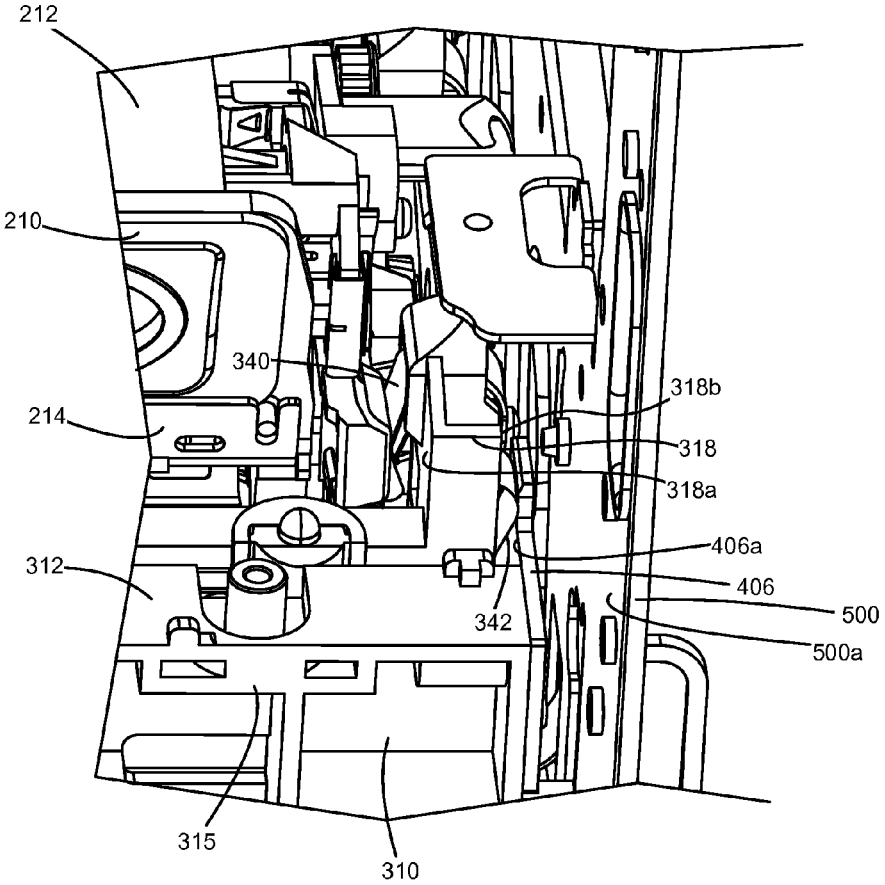
FIG. 9 is a perspective view showing a second biasing member of the photoconductor unit in contact with the imaging basket biasing the photoconductor unit along an axial dimension of the photoconductor unit according to one example embodiment.

With reference to FIGS. 6 and 9, photoconductor unit 300K includes a biasing member 342 positioned on an outer side 318*b* of end wall 318. In the embodiment illustrated, biasing member 340 is positioned above (closer to top 312) PC drum 302 and charge roll 304. Biasing member 342 extends outward axially with respect to PC drum 302 from outer side 318*b* of end wall 318 and is exposed on outer side 318*b* of end wall 318 in position to contact an inner surface 406*a* of plate 406 when photoconductor unit 300K is installed in imaging basket 400. As shown in FIG. 9, when photoconductor unit 300K is installed in imaging basket 400, biasing member 342 flexes between outer side 318*b* of end wall 318 of housing 310 and inner surface 406*a* of plate 406 thereby imparting an axial force on photoconductor unit 300K along the axial dimension of PC drum 302 (z-dimension in FIG. 4) toward end 317 of housing 310. Biasing member 342 is sized relative to biasing member 340 to ensure that the sum of the axial forces on photoconductor unit 300K toward end 317, which includes the force on photoconductor unit 300K from biasing member 342, exceeds the sum of the axial forces on photoconductor unit 300K toward end 316, which includes the force on photoconductor unit 300K from biasing member 340. The force from biasing member 342 on photoconductor unit 300K pushes housing 310 against an axial stop on imaging basket 400 and in this manner defines the axial position of photoconductor unit 300K. For example, in the embodiment illustrated, the force from biasing member 342 on photoconductor unit 300K pushes an endface 308 of a flange 309 (FIG. 7) surrounding bushing 307 on end 317 against inner surface 408*a* of plate 408 in order to ensure that PC drum 302 is axially aligned with developer roll 206 as well as the PC drums 302 of photoconductor units 300M, 300Y, 300C, ITM belt 54 and printhead 52. In the example embodiment illustrated, biasing member 342 is a leaf spring; however, any suitable biasing member may be used as discussed above, such as, for example, a compression spring or a material having resilient properties. In the example embodiment illustrated, biasing member 342 includes a tab 343 that extends outward axially with respect to PC drum 302 and upward toward top 312 at an angle to inner side 318*a* of end wall 318 when tab 343 is in its home position, i.e., when tab 343 is not deflected due to contact with plate 408. In other embodiments, tab 343 extends downward toward bottom 313 or sideways toward side 314 or 315 in order to form an angle to outer side 318*b* of end wall 318 when tab 343 is in its home position.

With reference back to FIGS. 6 and 7, in some embodiments, biasing members 340 and 342 are formed from a unitary piece of resilient material that passes through end wall 318 permitting the single piece of material to serve as both biasing member 340 on inner side 318*a* of end wall 318 and biasing member 342 on outer side 318*b* of end wall 318. In the embodiment illustrated, tabs 341 and 343 are formed at opposite ends of a curved segment 344 of resilient material with an intermediate member 345 of segment 344 connecting tab 341 and 343. Similarly, biasing members 340, 342 may include, for example, a pair of compression springs that are formed from a single piece of material and linked by an intermediate member of that material.

Figure 10:
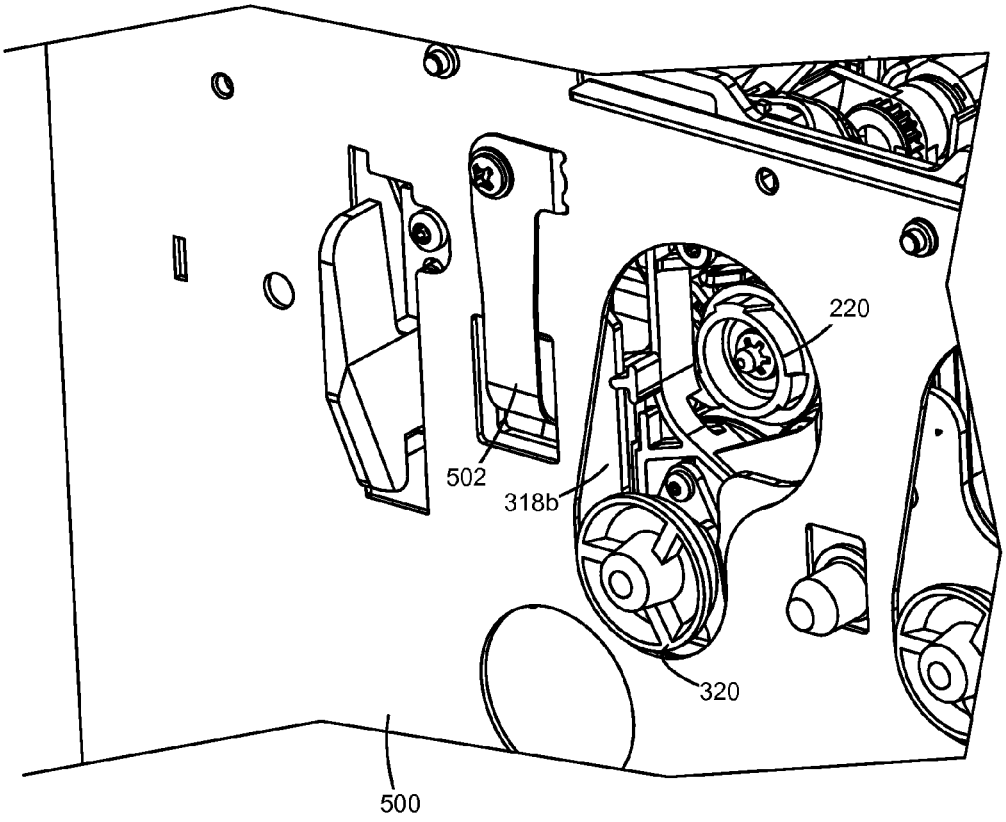
FIG. 10 is a perspective view showing a biasing member of the image forming device in contact with the photoconductor unit biasing the photoconductor unit along the axial dimension of the photoconductor unit according to one example embodiment.

With reference to FIG. 10, in some embodiments, imaging basket 400 includes a biasing member 502 that extends from a frame 500 of image forming device 20 and is positioned to contact outer surface 318*b* of end wall 318 of photoconductor 300K when photoconductor unit 300K is installed in imaging basket 400. When photoconductor unit 300K is installed in imaging basket 400, biasing member 502 flexes away from outer side 318*b* of end wall 318 of housing 310 toward an inner side 500*a* (FIG. 9) of frame 500 thereby imparting an axial force on photoconductor unit 300K along the axial dimension of PC drum 302 (z-dimension in FIG. 4) toward end 317 of housing 310. The additional force from biasing member 502 in the direction of end 317 ensures that housing 310 is pushed toward plate 408 against the axial stop on imaging basket 400. In the example embodiment illustrated, biasing member 502 is a leaf spring; however, any suitable biasing member may be used as discussed above, such as, for example, a compression spring or a material having resilient properties.

With reference back to FIGS. 4-7, photoconductor unit 300K also includes a pair of hold down pins 350, 351 positioned on top 312 of side 315 of housing 310 and spaced from each other along the axial dimension of PC drum 302. In the embodiment illustrated, pins 350, 351 are biased upward, such as by compression springs, and retained within guides 352, 353 on housing 310. As shown in FIGS. 2 and 3, imaging basket 400 includes a pair of corresponding hold down levers 416, 417 positioned along side 315 of housing 310. Levers 416, 417 are rotatable between a locked position shown in FIG. 2 and an unlocked position shown in FIG. 3. When photoconductor unit 300K is installed in imaging basket 400 with contact between bushings 306, 307 and v-shaped notches 410, 411 locating photoconductor unit 300K vertically and side-to-side and biasing member 342 locating photoconductor unit 300K axially, the user rotates levers 416, 417 from their unlocked positions to their locked positions in order to secure photoconductor unit 300K in imaging basket 400. As levers 416, 417 rotate toward their locked positions, a bottom surface of each lever 416, 417 contacts an exposed top surface of its corresponding pin 350, 351 imparting a downward force on each pin 350, 351 against the bias on pins 350, 351. The downward forces on pins 350, 351 prevent photoconductor unit 300K from lifting out of imaging basket 400 and ensure that housing 310 is rotated about the rotational axis of PC drum 302 so that rotational stops 336, 337 are in contact with corresponding stops 412, 413 thereby fixing the position of photoconductor unit 300K in imaging basket 400 for operation.

In some embodiments, in addition to axially locating developer unit 200K and photoconductor 300K, biasing members 340 and 342 of photoconductor unit 300K also provide electrical ground contacts for developer unit 200K and photoconductor unit 300K. In this embodiment, biasing members 340 and 342 are composed of an electrically conductive material, such as metal or electrically conductive plastic, and are electrically connected to each other, such as by being formed from a single piece of electrically conductive material as illustrated.

Figure 11:
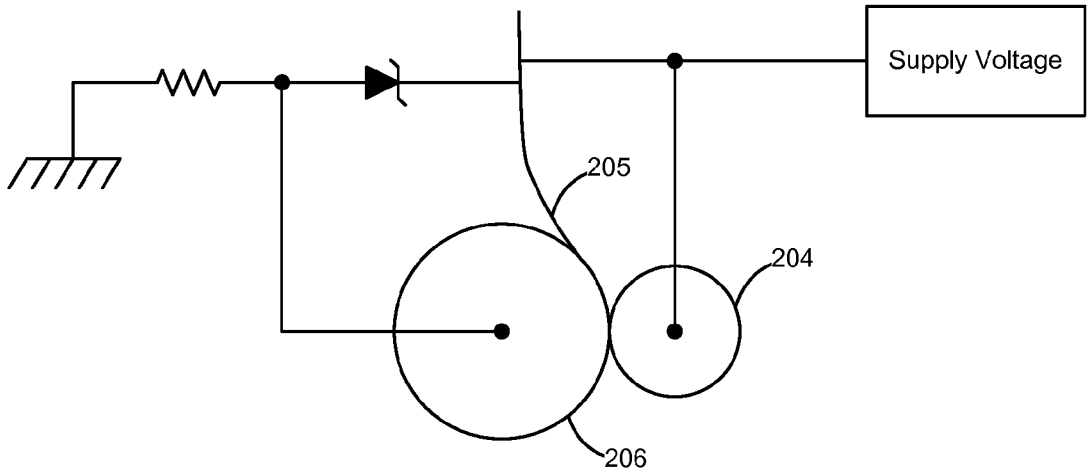
FIG. 11 is a schematic electrical diagram of the developer unit according to one example embodiment.
Figure 12:
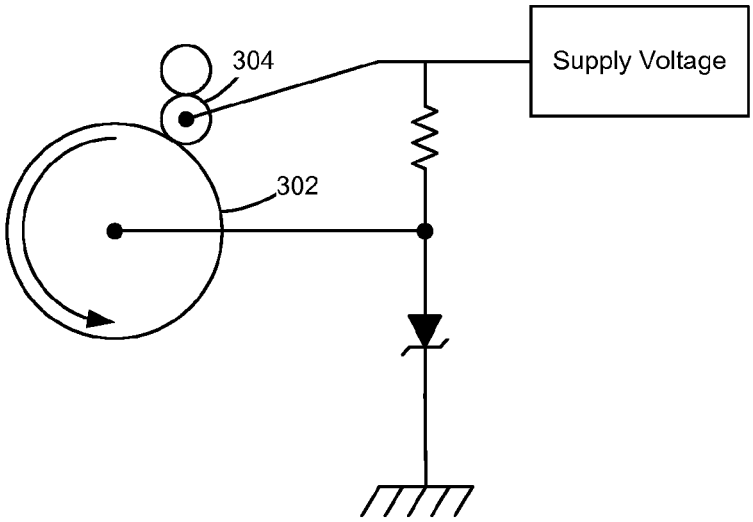
FIG. 12 is a schematic electrical diagram of the photoconductor unit according to one example embodiment.

FIGS. 11 and 12 are electrical schematics of developer unit 200K and photoconductor unit 300K, respectively, according to one example embodiment. As shown in FIG. 11, developer unit 200K includes a single voltage input that supplies an electrical load to toner adder roll 204, a doctor blade 205 and developer roll 206 and a single ground contact. As shown in FIG. 12, photoconductor unit 300K includes a single voltage input that supplies an electrical load to charge roll 304 and PC drum 302 and a single ground contact.

With reference to FIG. 7, in the embodiment illustrated, photoconductor unit 300K includes an electrical contact 360 exposed on end 317 that contacts a corresponding electrical contact in image forming device 20 when photoconductor unit 300K is installed in imaging basket 400. Electrical contact 360 receives the supply voltage for photoconductor unit 300K from image forming device 20. Biasing member 342 is electrically connected to electrical contact 360 through the circuit of photoconductor unit 300K illustrated in FIG. 12. As shown in FIG. 9, when photoconductor unit 300K is installed in imaging basket 400, biasing member 342 contacts inner surface 406*a* of plate 406, which is composed of metal. Plate 406 is in contact with metal frame 500 of image forming device 20 which serves as a chassis ground. With reference back to FIG. 7, similarly, developer unit 200K includes an electrical contact 240 exposed on end 217 that contacts a corresponding electrical contact in image forming device 20 when developer unit 200K is installed in imaging basket 400. Electrical contact 240 receives the supply voltage for developer unit 200K from image forming device 20. With reference to FIG. 6, developer unit 200K also includes an electrical contact 242 exposed on end 216. Electrical contact 242 is electrically connected to electrical contact 240 through the circuit of developer unit 200K illustrated in FIG. 11. As shown in FIG. 8, when developer unit 200K is operably mated with photoconductor unit 300K, electrical contact 242 contacts biasing member 340 on housing 310. Biasing member 340 is electrically connected to biasing member 342 such that the contact between biasing member 342 and plate 406 provides a ground path for photoconductor unit 300K in addition to providing a ground path for developer unit 200K.

As desired, photoconductor units 300M, 300Y, 300C may be removable from imaging basket 400 and may have the same construction as photoconductor units 300K. Similarly, developer units 200M, 200Y, 200C may have the same construction as developer unit 200K and may be fixed to or replaceable separate from their corresponding photoconductor units 300M, 300Y, 300C. Further, in another embodiment, imaging stations 50 do not include toner cartridges 100 and, instead, developer units 200K, 200M, 200Y, 200C include in their respective reservoirs 202 the main toner supply of each toner color.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A photoconductor unit for an electrophotographic image forming device, comprising:

a housing having a top, a bottom, a first side and a second side formed between a first end and a second end of the housing, a first end wall is positioned at a first end of the housing;

a photoconductive drum mounted on the housing having a rotational axis that runs from the first end to the second end;

an electrically conductive first biasing member extending axially inward with respect to the photoconductive drum from an inner axial side of the first end wall, the inner axial side of the first end wall faces toward the second end of the housing, the first biasing member is exposed on the inner axial side of the first end wall to contact and force a developer unit toward the second end of the housing when the developer unit is operably mated with the photoconductor unit and to contact and form an electrical path with a corresponding electrical contact on the developer unit when the developer unit is operably mated with the photoconductor unit; and an electrically conductive second biasing member extending axially outward with respect to the photoconductive drum from an outer axial side of the first end wall, the outer axial side of the first end wall faces away from the second end of the housing, the second biasing member is exposed on the outer axial side of the first end wall to contact a plate in the image forming device and force the photoconductor unit axially with respect to the photoconductive drum in the direction of the second end of the housing when the photoconductor unit is installed in the image forming device and to form an electrical path with the plate when the photoconductor unit is installed in the image forming device, wherein the electrically conductive second biasing member is electrically connected to a circuit of the photoconductor unit that includes the photoconductive drum to electrically ground the circuit of the photoconductor unit to the plate when the photoconductor unit is installed in the image forming device.

2. The photoconductor unit of claim 1, wherein the electrically conductive first biasing member is electrically connected to the electrically conductive second biasing member to electrically ground a circuit of the developer unit to the plate when the developer unit is operably mated with the photoconductor unit and the photoconductor unit is installed in the image forming device.

3. The photoconductor unit of claim 1, wherein the first biasing member is positioned on the inner axial side of the first end wall above the photoconductive drum.

4. A photoconductor unit for an electrophotographic image forming device, comprising:

a housing having a top, a bottom, a first side and a second side formed between a first end and a second end of the housing, a first end wall is positioned at a first end of the housing;

a photoconductive drum mounted on the housing having a rotational axis that runs from the first end to the second end;

a first flexible metal tab extending axially inward with respect to the photoconductive drum from an inner axial side of the first end wall, the inner axial side of the first end wall faces toward the second end of the housing, the first flexible metal tab is exposed on the inner axial side of the first end wall to contact and force a developer unit toward the second end of the housing when the developer unit is operably mated with the photoconductor unit and to contact and form an electrical path with a corresponding electrical contact on the developer unit when the developer unit is operably mated with the photoconductor unit; and a second flexible metal tab extending axially outward with respect to the photoconductive drum from an outer axial side of the first end wall, the outer axial side of the first end wall faces away from the second end of the housing, the second flexible metal tab is exposed on the outer axial side of the first end wall to contact a plate in the image forming device and force the photoconductor unit axially with respect to the photoconductive drum in the direction of the second end of the housing when the photoconductor unit is installed in the image forming device and to form an electrical path with the plate when the photoconductor unit is installed in the image forming device, wherein the second flexible metal tab is electrically connected to a circuit of the photoconductor unit that includes the photoconductive drum to electrically ground the circuit of the photoconductor unit to the plate when the photoconductor unit is installed in the image forming device.

5. The photoconductor unit of claim 4, wherein the first flexible metal tab is electrically connected to the second flexible metal tab to electrically ground a circuit of the developer unit to the plate when the developer unit is operably mated with the photoconductor unit and the photoconductor unit is installed in the image forming device.

6. The photoconductor unit of claim 4, wherein the first flexible metal tab is positioned on the inner axial side of the first end wall above the photoconductive drum.

7. A replaceable unit for an electrophotographic image forming device, comprising:

a photoconductor unit portion that includes a photoconductive drum having a first rotational axis that extends from a first end of the replaceable unit to a second end of the replaceable unit;

a developer unit portion that includes a reservoir for storing toner and a developer roll having a second rotational axis that extends from the first end of the replaceable unit to the second end of the replaceable unit, an outer surface of the developer roll is positioned along an outer surface of the photoconductive drum to deliver toner from the reservoir to the photoconductive drum; and an electrically conductive first biasing member positioned between the photoconductor unit portion and the developer unit portion forcing the developer unit portion axially with respect to the photoconductive drum toward the second end of the replaceable unit and forming an electrical path between a first electrical contact on the developer unit portion and a second electrical contact on the photoconductor unit portion.

8. The replaceable unit of claim 7, further comprising an electrically conductive second biasing member positioned on an outer surface of the replaceable unit at the first end of the replaceable unit to contact a plate in the image forming device and force the photoconductor unit portion axially with respect to the photoconductive drum in the direction of the second end of the replaceable unit when the replaceable unit is installed in the image forming device and to form an electrical path between the electrically conductive second biasing member and the plate.

9. The replaceable unit of claim 8, wherein the second electrical contact on the photoconductor unit portion is electrically connected to the electrically conductive second biasing member.

10. The replaceable unit of claim 8, wherein the electrically conductive second biasing member is electrically connected to a circuit of the photoconductor unit portion that includes the photoconductive drum to electrically ground the circuit of the photoconductor unit portion to the plate when the replaceable unit is installed in the image forming device.

11. The replaceable unit of claim 10, wherein the first electrical contact on the developer unit portion is electrically connected to a circuit of the developer unit portion that includes the developer roll and the second electrical contact on the photoconductor unit portion is electrically connected to the electrically conductive second biasing member to electrically ground the circuit of the developer unit portion to the plate when the replaceable unit is installed in the image forming device.

12. The replaceable unit of claim 7, wherein the electrically conductive first biasing member is attached to the photoconductor unit portion.

* * * * *